US006550302B1

(12) United States Patent
Ghosh

(10) Patent No.: US 6,550,302 B1
(45) Date of Patent: Apr. 22, 2003

(54) SHEET METAL STAMPING DIE DESIGN FOR WARM FORMING

(75) Inventor: Amit K. Ghosh, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 24 days.

(21) Appl. No.: 09/625,426

(22) Filed: Jul. 25, 2000

Related U.S. Application Data

(60) Provisional application No. 60/145,784, filed on Jul. 27, 1999.

(51) Int. Cl.[7] ..... B21D 37/16

(52) U.S. Cl. ..... 72/342.8; 72/342.7; 72/347

(58) Field of Search ..... 72/342.1, 342.7, 72/342.8, 342.92, 347, 350, 364

(56) References Cited

U.S. PATENT DOCUMENTS

| | | | | |
|---|---|---|---|---|
| 2,455,702 A | | 12/1948 | Rechton et al. | 153/21 |
| 2,760,543 A | | 8/1956 | Wood | 153/21 |
| 2,944,500 A | | 7/1960 | Raynes | 113/43 |
| 2,966,195 A | | 12/1960 | Roberts et al. | 153/21 |
| 3,025,905 A | * | 3/1962 | Haerr | 72/342.92 |
| 3,528,276 A | | 9/1970 | Schmidt et al. | 72/342 |
| 3,926,029 A | | 12/1975 | Abson et al. | 72/342 |
| 4,137,105 A | | 1/1979 | Ness | 148/11.5 R |
| 4,145,903 A | | 3/1979 | Leach et al. | 72/60 |
| 4,227,396 A | | 10/1980 | Crowe | 72/69 |
| 4,584,860 A | | 4/1986 | Leonard | 72/61 |
| 4,888,973 A | | 12/1989 | Comley | 72/342 |
| 5,419,791 A | | 5/1995 | Folmer | 148/585 |
| 5,515,705 A | | 5/1996 | Weldon et al. | 72/19.1 |
| 5,729,462 A | | 3/1998 | Newkirk et al. | 364/468.25 |

FOREIGN PATENT DOCUMENTS

| | | | |
|---|---|---|---|
| FR | 2692504 | * 12/1993 | 72/342.8 |
| JP | 62-270225 | * 11/1987 | 72/342.7 |
| JP | 5-212485 | * 8/1993 | 72/342.7 |
| JP | 6-55230 | * 3/1994 | 72/342.92 |
| JP | 6-79353 | * 3/1994 | 72/342.8 |
| SU | 1409379 | * 7/1988 | 72/342.7 |

* cited by examiner

*Primary Examiner*—Ed Tolan
(74) *Attorney, Agent, or Firm*—Barbara M. Burns

(57) ABSTRACT

In metal stamping dies, by taking advantage of improved material flow by selectively warming the die, flat sections of the die can contribute to the flow of material throughout the workpiece. Local surface heating can be accomplished by placing a heating block in the die. Distribution of heating at the flat lower train central regions outside of the bend region allows a softer flow at a lower stress to enable material flow into the thinner, higher strain areas at the bend/s. The heating block is inserted into the die and is powered by a power supply.

12 Claims, 18 Drawing Sheets

FIG 7A
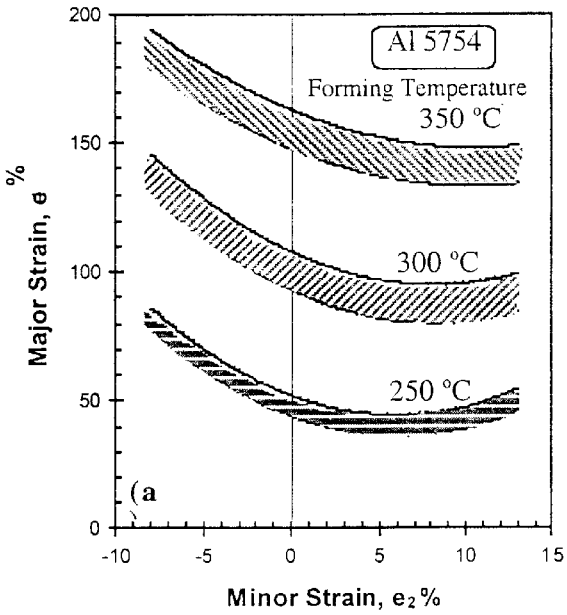
FIG 7B
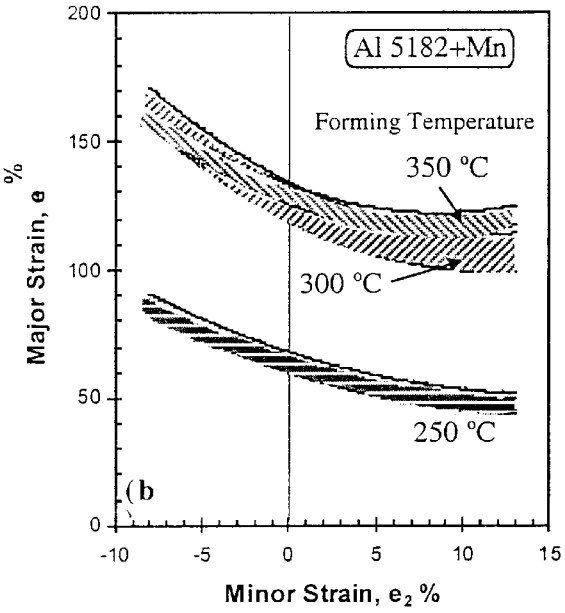
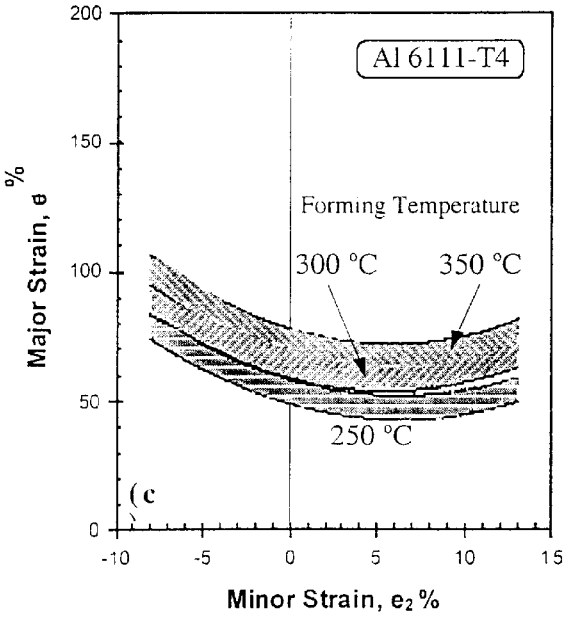
FIG 7C

FIG 8A
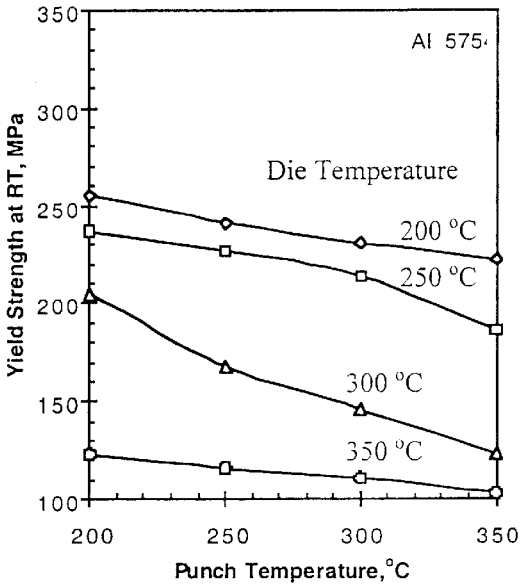
FIG 8B
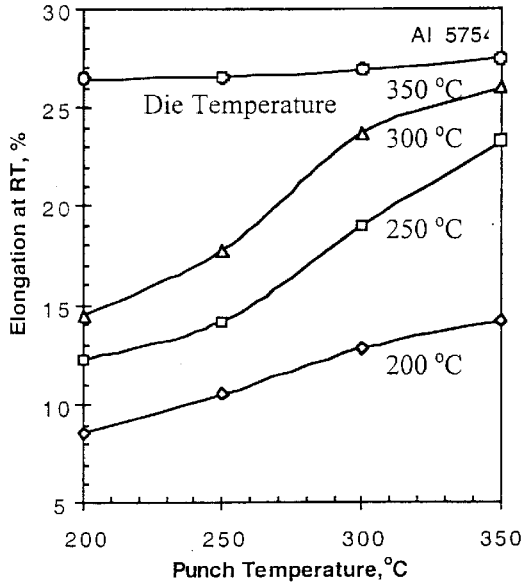
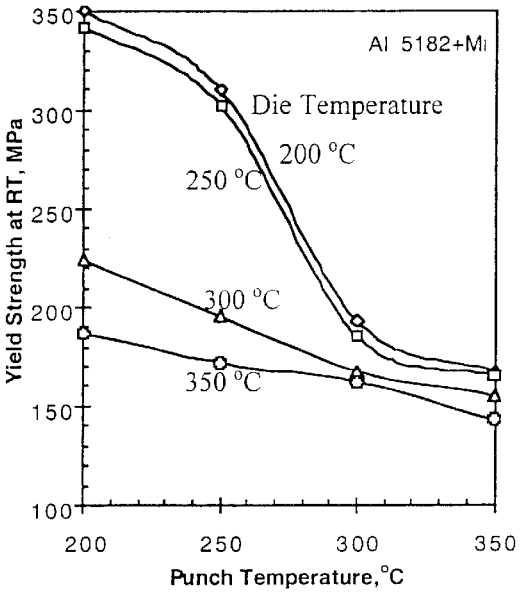
FIG 8C
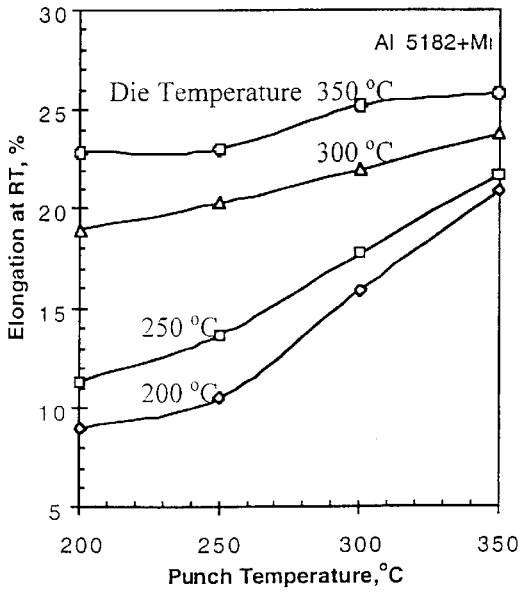
FIG 8D

FIG 9A
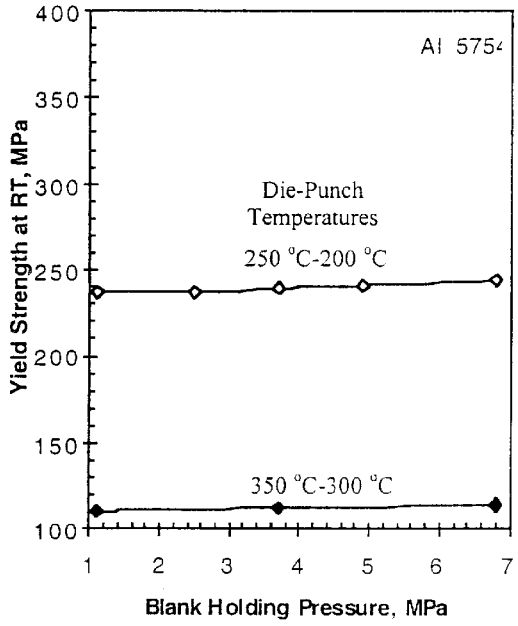
FIG 9B
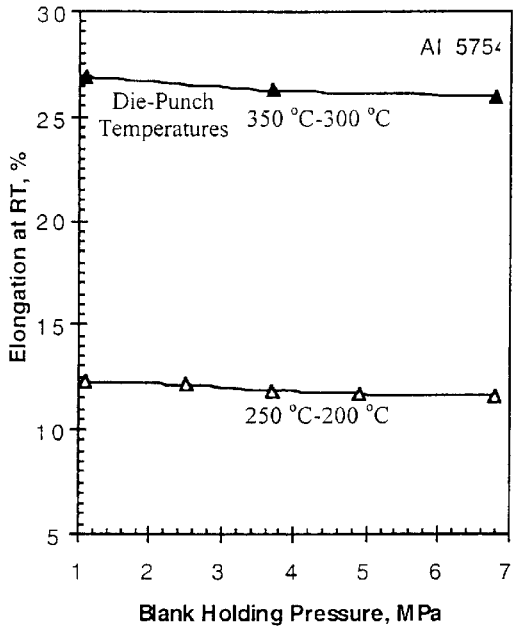
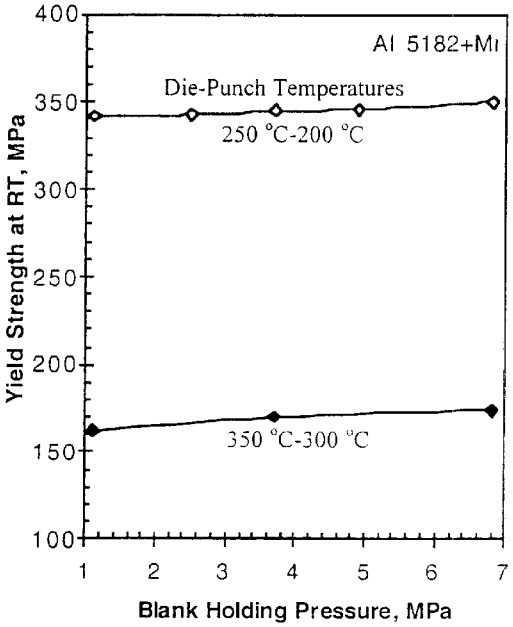
FIG 9C
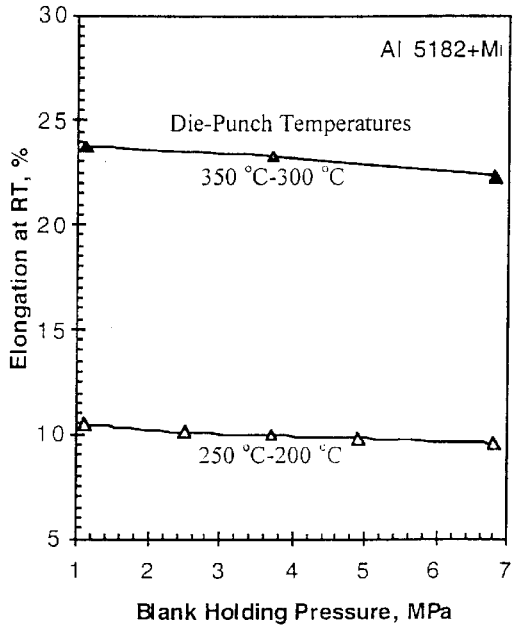
FIG 9D

FIG 10A
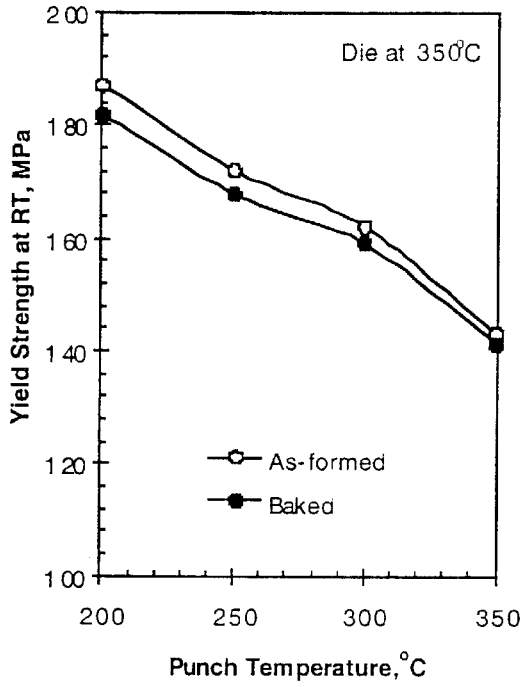
FIG 10B
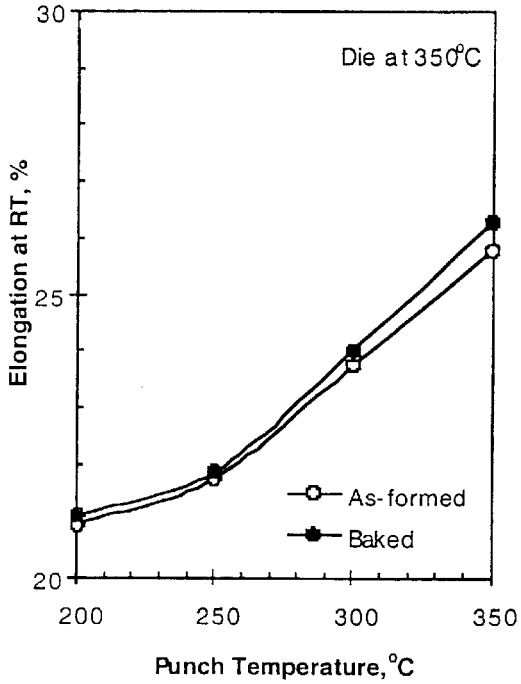
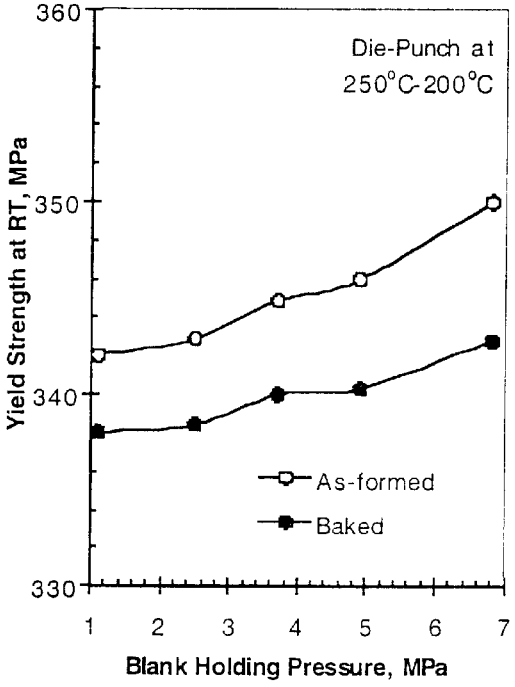
FIG 10C
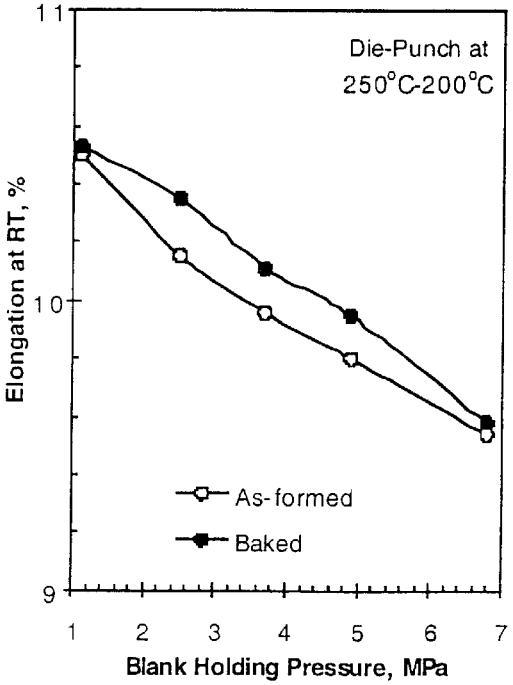
FIG 10D

Table 1 Chemical Compositions (wt. %) of Sheet Alloys

| | Si | Mg | Cu | Mn | Fe | Al |
|---|---|---|---|---|---|---|
| **5754** | 0.2 | 3.1 | 0.04 | 0.25 | – | balance |
| **5182+Mn** | 0.07 | 4.05 | 0.03 | 1.26 | 0.22 | balance |
| **6111** | 0.5-0.9 | 0.6 | – | – | – | balance |

Table 2 Room Temperature Tensile Properties Obtained for Different Tempers

| Alloy and Temper | | Yield Strength, MPa (0.2% Off-set) | Elongation, % (25.4mm Gauge Length) |
|---|---|---|---|
| Al 5754: | Hot-rolled (as-received) | 101 | 29 |
| | Cold-rolled (before warm-forming) | 254 | 7 |
| | After 200 °C forming | 255 | 8 |
| | After 350 °C forming | 105 | 27 |
| Al 5182+1%Mn: | Hot-rolled (as-received) | 217 | 25 |
| | Cold-rolled (before warm-forming) | 351 | 6 |
| | After 200 °C forming | 350 | 9 |
| | After 350 °C forming | 150 | 26 |
| Al 6111: | Hot-rolled (as-received) | 160 | 16 |
| | T4 (before warm-forming) | 169 | 21 |
| | After 200 °C forming | 174 | 19 |
| | After 350 °C forming | 148 | 27 |

SHEET METAL STAMPING DIE DESIGN FOR WARM FORMING

REFERENCE TO RELATED APPLICATION

This application is based on provisional patent application No. 60/145,784, filed Jul. 27, 1999.

This invention was made in part with government support awarded by the Department of Energy Contract LMES 86-X-SU544C. The government has certain rights in the invention.

BACKGROUND OF THE INVENTION

The field of the invention pertains to sheet metal stamping and in particular to an apparatus and method to facilitate forming of metal. Material stretches more at a deformation or corner and becomes thinner thereat.

Aluminum is a brittle material, that is, alumninum is less ductile than other materials. In the past, a die was entirely heated or the sheet of material was entirely heated to facilitate flow during the stamping/molding process. An individual punch could also be heated.

Heating of certain metals to modest temperatures above room temperature can increase their strain to failure, and simultaneously increase their strain rate sensitivity. These characteristics produce favorable conditions for forming sheet metals, but strain localization at elevated temperatures can be intense due to a loss in their work hardening capacity thus minimizing strain uniformity in the part. Maintaining of spatial variation in temperature on mated die surfaces can allow flow of softened material from certain sections of the part to other regions to enhance the overall formability of sheets. It is however not clear as how to provide appropriate control of differential temperature in different regions of the die or how to construct these dies to avoid excessive heat loss, support of internally imbedded heating elements without heat equilibrium between different regions and provide the most desirable extent of metal flow.

Recently there has been a remarkable increase in the use of aluminum alloys in automotive industry, e.g. the shipment of aluminum to automotive market increased from 1.6 billion pounds in 1987 to 4.04 billion pounds in 1997. This increase is attributed not only to issues of energy-saving, but also to those of safety, resource conservation and environment friendliness. However, structural and body parts that rely on the formability of sheet metals, aluminum alloys are ranked far behind low carbon steels in automotive applications, despite their higher strength-to-weight ratio and excellent corrosion resistance. The limited use of aluminum alloys in the automotive industry is partly due to their poor formability at room temperature and thus, if warm forming at a rapid forming rate can be implemented in production, many of the goals related to lightweighting, energy and environmental friendliness can be realized.

Warm forming by deep drawing both rectangular and circular cups from annealed and hardened aluminum sheet alloys has been investigated in the past. Studies showed significant improvement in the drawability (in terms of cup height) at a relatively moderate temperature of about 150 degrees C. even for the precipitation hardened alloys (like 2024-T4 and 7075-T6). The drawability of these hardened alloys are better than the annealed alloys at room temperature, suggesting the possibility of drawing high strength aluminum alloys for structural parts at moderate elevated temperatures rather than drawing them in the annealed state and heat-treating after forming.

Forming speed (strain rate) effect in addition to temperature effect was observed with cup height increased with increasing forming temperature and/or decreasing punch speed for an Al—2Mg alloy. Punch stretching alloy 5182-O, required similar temperature and forming speed. Strains near the neck of the stretched part were more uniformly distributed at higher temperatures and slower punch speeds, implying increased strain rate sensitivity. By punch stretching the same alloy at a typical automotive strain rate of 1 sec-1, forming temperature had to exceed about 250 degrees C. to make improvements over the room temperature value, or, the punch speed had to be slow enough (about 10% of a typical automotive strain rate) to exhibit improved warm forming performance over that of AKDQ steel at room temperature. Moreover, plant trials of warm forming were conducted, forming alloy 5182-O at 120 degrees C. in General Motors proved successful in producing inner door panels and a V-6 oil pan at commercial press speeds, by heating both the die and the blank and using a mica lubricant and a MoSi2/graphite release agent. Cooperative investigations between Alcan and Chrysler tested various alloys, precipitation hardenable bumper alloys 7046-T6 and 7029-T6 to the strain hardenable alloys 5182-H14 and 5083-H14, were tested at elevated temperatures using heated blanks but unheated dies. It was found that some precipitation hardened alloys could also be warm formed successfully to produce components at 250 degrees C. at a cycling rate (~5 parts/min.). The optimum forming temperatures were found to be 200 degrees C. and 250 degrees C. for the precipitation hardened and the strain hardened alloys, respectively. These early trials act as an important database for today's advanced manufacturing and/or further exploration of warm forming potential of existing and new aluminum alloys.

The need for Fuel Savings and Structural Weight Reduction in vehicles is driving the replacement of Steel by Aluminum. But formability of Al alloys is half that of steels. This poses a major economic barrier to its application Goal: Formability of Al alloys must be improved under rapid manufacturing conditions (strain rate ~1–10 s–1). Technical Issues: Most Aluminum Alloys have the lowest formability at or near room temperature. At temperatures below room temperature, Strain Hardening Rate of Al Alloys is improved somewhat, but not enough. At Modestly Elevated Temperatures (200–350° C.), the Strain Rate Sensitivity and Forming Limit of Al alloys are improved significantly. L(derÕs Band and Surface Defects are eliminated by Warm Forming. Critical Questions:Warm formability drops with increasing Forming Rate. Can sufficient formability be achieved at high strain rate? Which alloys and micro structure will maximize warm formability and yet not degrade room temperature strength?

In uniaxial tension, total elongation generally increases with increasing temperature but decreases with increasing strain rate. Strain rate sensitivity increases with increasing temperature. Strain hardening index decreases with increasing temperature, indicating a softening effect. However, the warm forming as described above has been directed to warming of the blank and/or the entire die and not selective warming of certain segments of a die.

SUMMARY OF THE INVENTION

It is therefore an object of this invention to provide selective heating to a die facilitate warm forming.

It is also an object of this invention to provide such selective heating to enable material flow into a end region from a flat region of a die.

It is a further object of this invention to provide such selective heating by using a heating block with a heating element positioned to heat the flat region of the die.

By taking advantage of improved material flow by selectively warming the die, flat sections of the die can contribute to the flow of material throughout the workpiece. Distribution of heating at the flat lower strain central regions outside of the bend region allows a softer flow at a lower stress to enable material flow into the thinner, higher strain areas at the bend/s.

Often die geometry poses restrictions on the easy flow of metal from one region of the part to another, thus leaving relatively unstretched regions of the part bounded by heavily stretched areas. The formability of the metal is poorly utilized due to the strain non-uniformity, and the propensity for fracture increases. This occurs because it is difficult to transmit stresses into certain regions of the sheet metal workpiece due to high frictional resistance or larger cross-sectional area in these regions, (as in the flange of a die). To encourage more plastic stretching in these regions, the local area needs to be softened, such as by raising the local temperature.

The formability of a sheet metal is a complex measure of its ability to accommodate the strains experienced in a forming process and to produce a part satisfying specific requirements of dimension, appearance and mechanics. Formability depends on not only the intrinsic or constitutive properties of the sheet metal but also the extrinsic factors encountered in a practical forming operation. Both experimental and analytical formability studies indicate that strain hardening behavior end, especially, the strain rate hardening properties play an important role in influencing the forming limit strain.

Since these properties result directly from microstructural characteristics of the sheet metal, it is understood that the formability can also be influenced by alloying, grain size, precipitation process and texture formation given a material and a process, the extrinsic factors (mechanical, environmental, etc.) generally have a significant and more dominant effect on the formability. Certain extrinsic variables have been identiifed, including temperature gradient, forming rate/strain rate, blank holding force, tooling, e.g. die-punch design, lubrication and deformation history. Considering the complex interaction between the extrinsic variables (e.g. temperature) and the metallurgical or microstructural process of the sheet metal, the forming performance control in an industrial operation can be even more complicated.

The biaxial warm forming behavior of aluminum alloys using the invention are are discussed herein. Three alloys were used from the 5000 and 6000 series alloys based on their current applications in automotive industry. These alloys were: the strain hardenable alloys Al 5754 and Al 5182 containing 1%Mn (5182+Mn) and the precipitation hardenable alloy 6111-T4. A temperature range of 200–350 degrees C. was selected. The external part geometry selected was a rectangular part with dimensions of 200 mm (140 mm, with edge radius of about 5 mm, which simulates the edge of many parts used in industry. The forming variables included temperature and blank holding pressure. Forming limit diagrams (FLDs) indicating the limiting strains for the forming operation are characterized in detail as a function of temperature. Post-forming mechanical properties at room temperature are also studied to assess the expected strength of formed parts for their applications in service.

Three sheet alloys were demonstrated for the present biaxial warm forming, namely, the strain hardenable aluminum alloys 5754 and 5182+Mn and the precipitation hardenable alloy 6111-T4. The alloy 5182+Mn was modified from commercial alloy 5182 by adding about 1% Mn as dispersoid former, for the enhancement of the strain rate sensitivity of flow stress. Table 1 gives the chemical compositions of the alloys investigated. The three sheet alloys were cold rolled from a hot-rolled gauge of 5.3 mm for Al 5754, 7.5 mm for Al 5182+Mn and 3.5 mm for Al 6111, to a final thickness of 0.9 mm, leading to reduction ratios of 83% for 5754, 88% for 5182+Mn, and 74% for 6111.

For alloy 6111, the cold-rolled sheets were further treated in T4 condition, i.e. solution heated at 532 degrees C. for 30 minutes, water quenched, and naturally aged for more than 5 days. For the biaxial tests, the sheets were cut to rectangular blank samples of a size of L(W=200(140 (mm), with L in rolling direction. To measure the forming strain distribution, the surface of these blanks were electrochemically pre-etched a grid network with a cell size of 1.27(1.27 (mm). Boron nitride powder was used as the lubricant and it was sprayed on the blanks and baked to a dry condition. The dry boron nitride layer was a good lubricant for elevated temperature operations. It could be used without burning (like oil) and surface damage (like graphite) and could be easily removed by washing in water. Forming was performed on a heated rectangular die-punch device designed to simulate commonly observed biaxial parts and die edge radii. FIG. 1-*a* shows a schematic diagram of the main part of the warm forming test device and FIG. 1-*b* gives a photograph of the die-punch configuration. The rectangular punch geometry also offers edge and corner radii similar to that in an actual stamping. The cross-sectional area was 10 mm (50 mm for the die cavity and 100 mm (40 mm for the punch. Both the die edge and the punch had a radius of about 5 mm. The die and the punch were heated by embedded heating elements. Thermocouples were inserted in different heating areas of the die and the punch, and temperature was controlled by using PID devices, within a range of (4 degrees C. The punch-die device were mounted on an Instron-1116 testing machine with 250 kN capacity. The punch was moved by moving the cross-head. The upper die plate was maintained in a fixed position in the die apparatus while the lower die plate was moved upward by using the pistons of three ENERPAC hydraulic cylinders to clamp the sheet between them.

The die and the punch were preheated to desired temperature(s) and then the sheet sample was put onto an aligned, centrally located position marked on the lower die. A specified blank holding pressure was then applied rapidly on the sheet resting between the upper and the lower die plates to tightly clamp the sheet. The forming temperature range was selected to be within 200~350 degrees C., and room temperature tests were used as baseline reference.

Thermal calibration was checked with attached thermocouples and closing the dies on the thermocouples. A thermal equilibrium could be reached in just a few seconds. The punch advance speed was fixed at 10 mm/sec., the maximum speed available in this machine, providing local strain rates in the small test sample close to commercial stamping strain rate. Load vs punch displacement curves were recorded using an X-Y data recorder and the data were utilized to obtain the depth of a formed part at peak load (where necking occurred on the sheet). This part depth was used as a measure of formability.

To evaluate forming strain distribution and to construct FLDs, the pre-etched grid size was measured using a video camera and digitally processed by a computer program (Scion Image) for the warm formed rectangular parts. The measurements were made along both longitudinal and transverse as and around the crack. After strain measurement from each formed part, the flat central section was cut out to make tensile test specimens. The orientation of the tensile axis was parallel to the longitudinal axis (also the cold rolling direction). The tensile specimen had a gauge length of 25.4 mm (1 in.) and a width of 6.35 mm (¼ in.), with an as-formed thickness of about 0.9 mm. The tensile tests were performed in the as-formed temper as well as after a paint bake treatment (177 degrees C. for 30 minutes). This treatment condition was recommended by the US Automotive Consortium. The strength and elongation values were measured at room temperature on an Instron-4505 testing machine using a cross-head speed of 5 mm/min.

A rectangular cup-shaped part was produced as a result of biaxial warm forming. The formability was evaluated by part depth defined as the maximum punch penetration before a crack initiates. In FIG. 2, part depth is plotted against punch temperature at different die temperatures for the three sheet alloys, with alloys 5754 and 5182+Mn in the cold-rolled conditions and alloy 6111 in the T4 condition prior to warm forming tests. Here blank holding pressure is set at 1.1 MPa for comparing temperature effects.

Punch temperature and die temperature both affect part depth significantly, and the part depth—forming temperature relations do not follow a monotonic manner but depend on die-punch temperature combinations. Considering the part depth data at room temperature (2.5 mnm, 5.5 mm and 6 mm for Al 5182+Mn, Al 5754 and Al 6111-T4, respectively), it is no doubt that warm forming remarkably improves the formability of these sheet alloys. When die temperature is relatively low ((~300 degrees C. for Al 5754 and 6111, (~250 degrees C. for Al 5182+Mn), part depth generally decreases with increasing punch temperature, while it increases with increasing die temperature for a fixed punch temperature. As punch temperature relative to die temperature increases, there is an increase in the ratio of the material being stretched to the material being drawn-in. At these low temperatures, the stretchability of the sheet metal is very low, due to the low strain rate sensitivity. As a result, the more the stretching is applied, the earlier the crack initiates. The decrease in part depth with increasing punch temperature suggests that the formability at low forming temperatures is predominately contributed by the drawability of the sheet metal. At higher die temperatures, part depth first increases with punch temperature, saturates to make a maximum and then decreases. Apart form some microstructural effects possibly out of the recovery process, the sheet metal+s stretchability may begin playing a more significant role than at lower die temperatures, presumably due to the increased strain rate sensitivity associated with high forming temperatures.

As a special case of the various die-punch temperature settings in FIG. 2, the forming behavior obtained under isothermal conditions (i.e. die and punch at the same temperature) is shown separately in FIG. 3, for an explicit view. It is clear from FIG. 3 that there is a single monotonic trend of the part depth increase with increasing forming temperature. Under isothermal conditions, increasing temperature facilitates the improvements op both drawabillty and stretchability. However, it should be noted that isothermal heating does not represent an optimum heating condition for the present type of biaxial forming operation. Rather, as can be seen from FIG. 2, an optimum part depth is obtained under a thermal gradient condition that sets die temperature higher than punch temperature. A compared with earlier investigations that noted that, under the condition of a cold die and warm sheet, the die would take some heat from the sheet and the formability of the sheet metal would be reduced. On the contrary, a good formability has been reported to be achieved by using heated die and un-heated punch. Summarizing the forming performance data for the sheet alloys and forming conditions investigated in the present investigation, the optimum part depth is found to be achieved by setting die temperature about 50 degrees C. higher than punch temperature. This means that letting punch totally unheated will not give an optimum forming performance for the aluminum alloys used in the present investigation.

Blank holder force plays an important role in influencing the formability of sheet metal parts. Considering that warm forming process may bring new characteristics to the blank holder force effects, it is assumed necessary to conduct some preliminary studies under elevated temperature forming conditions. The blank holder force is expressed by a blank holding pressure (BHP) supplied by an oil pump to the lower die. Initially, blank holding pressure has been maintained to be constant during the whole forming process. FIG. 4 shows how part depth varies with blank holding pressure at various die-punch temperature combinations. For a gross trend, part depth generally decreases with increasing BHP. It is understood that increasing BHP imposes an increased difficulty in drawing sheet metal into the die cavity. Comparing the part depth-BHP curves in FIG. 4 for different die-punch temperature settings, it is then noted that, at low forming temperatures (especially under thermal gradient conditions), there appear a trough and a peak occurring at some intermediate BHP values, or, to a less degree, part depth stops decreasing at these BHP values. This phenomenon is understood by checking experimentally the variation of multiple variables, namely, drawability, stretchability and wrinkling, as BHP and forming temperature change. The present invention shows that formability, expressed by part depth, is contributed by drawability and stretchability, with the former dominating the process. The occurrence of wrinkling affects the formability through obstructing the drawing-in process. At a relatively low die-punch temperature setting, e.g. 250 degrees C.–200 degrees C., wrinkling of the blank flange region is a prominent issue at low BHPs. Wrinkling disappears when BHP is large enough (>1.1 MPa for Al 5182+Mn, >2.5 MPa for Al 5754). At low BHP values, the occurrence of wrinkling obstructs the flow of the sheet metal into the die cavity, in addition to the restriction of drawing due to an increase in BHP.

That is, the drawability initially decreases steeply with increasing BHP. Then, the onset of the disappearance of wrinkling brings a –break-through+ in improving the drawability, and the decrease in drawability becomes very moderate or nearly halted. Note that the stretchability of the sheet metal increases monotonically with increasing BHP. As such, the halted decrease in the drawability and the continuing increase in the stretchability could lead to a temporary elevation of part depth with increasing BHP. After the break-through, the drawability comes back to the track of monotonic BHP-control and it decreases steadily with increasing BHP. When the forming temperature is high enough, e.g. at a die-punch temperature setting of 350 degrees C.–300 degrees C., wrinkling no longer occurs, which is in accordance with some previous reports [e.g. 26] that increasing temperature could result in a decrease in the occurrence of wrinkling. Consequently, at high forming temperatures, there comes a roughly single trend that the drawability and hence, part depth, decreases monotonically with increasing BHP. Under conditions of isothermal heating where die and punch are set to the same temperature, by contrast, the occurrence of wrinkling is much less likely than in the case of thermal gradient. At 250 degrees C., for instance, wrinkling has only been evidenced in the parts of alloy 5182+Mn formed at the lowest BHP of 1.1 MPa. With little or no occurrence of wrinkling, part depth, which is primary dependent on the drawability, decreases monotonically with increasing BHP. It is worth noting that increasing BHP can both prevent effectively the occurrence of blank writings and impose an obstruction to the metal flowing into the die cavity. In view of the present observations, the latter effect seems more dominant and hence, a low BHP is generally more favorable in obtaining a high part depth. The formability of the three alloys exhibit promising forming performance at elevated temperatures, however the formability of the precipitation hardened alloy 6111-T4 is not comparable to the two strain hardened alloys 5754 and 5182+Mn. Regarding the temperature dependence of the forming behavior for alloys 5754 and 5182+Mn, it is indicated in FIG. 2 that the formability of the former seems to be more sensitive to forming temperature than the latter. Especially, for die temperatures at and higher than 300° C., the part depth of alloy 5182+Mn becomes quite insensitive to punch and die temperatures. Moreover, comparing the responses of the two strain hardened alloys to BHP, it is noted from FIG. 4 that the formability of alloy 5182+Mn is also relatively insensitive to BHP, similar to its temperature insensitivity in high forming temperature range. In fact, part depth data points for various BHP and die-punch temperature values fall into a quite narrow band in FIG. 4-*b*. From a viewpoint of engineering, the insensitivity to forming temperature and BHP means ease in handling the process, while the sensitivity allows flexibility in tailoring sheet metals+ performance.

The limits of formability for forming sheet metals have long been described in terms of the principal strains (major and minor strains), which are frequently measured by means of electrochemically etched grids, to construct a forming limit diagram (FLD). An FLD divides the region of strain field that is safe for a specific forming operation from the one that can lead to failure of the forming operation. In most cases, it is generated by conducting stretching type tests. The present biaxial forming is primarily a drawing type operation and the formability is mainly controlled by the drawability, which is represented by part depth, as described in the preceding section. However, since the stretchability of aluminum alloys varies significantly as forming temperature is elevated, the strain distribution on the formed part may change drastically. Also, most formability data on conventional automotive sheet metals have been built in terms of FLDs.

Therefore, efforts have also been made to construct FLDs for the present warm formed aluminum parts. Before measuring the principal strains for the formation of FLD, it seems necessary to understand the crack initiation mode that is dependent on the specific forming conditions. Among other variables, temperature has been regarded as an important parameter to control the distribution of strain in a formed part. Different strain distributions are generally associated with and reflected in different failure modes characterized by specific crack initiation sites.

The invention indicates that the type of strain distribution causing characteristic crack initiation and failure is primarily controlled by the particular die-punch temperature setting, and BHP has little effect on this issue (at least true for the pressure values less than 7 MPa presently tested). FIG. 5 illustrates schematically two basic types of locations for FLD measurements, corresponding to two types of crack initiation modes linked to two different die-punch temperature assignments. When die temperature is set higher than punch temperature, cooler punch promotes drawing and the drawing-in is easier along minor axis than along major axis and hence, crack generally initiates at the edge of the rectangular cup (FIG. 5, Location Type 1) contacting the transverse dimensional die radius. On the contrary, when die temperature is set lower than punch temperature, hotter punch allows for relatively more stretching and hence, strain concentration and crack initiation generally occur at the cup bottom edge (FIG. 5, Location Type 2) contacting the punch nose radius and/or on the bottom corner. When die and punch are set at the same temperature (an isothermal heating condition), crack may initiate at Type 1 and/or Type 2 locations in FIG. 5, but with the more likelihood in Type 2. Since Type 1 locations provide strain data mostly for compressive minor strains whereas Type 2 locations provide strain data mostly for tensile minor strains, cracking sites associated with the isothermal heating condition have been utilized in the present FLD measurements. And, the construction of one FLD requires measurements around at least two cracking sites that include both Type 1 and Type 2 locations. Strain measurement makes use of pre-etched grids cut through by a crack and those neighboring grids free from cracking, an idea similar to that proposed by Hecker [29]. FIG. 6 gives an example showing how a data point on the limit strain map correlates a specific location of grid in the cracked area. While multiple cracking sites are required for constructing an FLD, only one such sites is shown in FIG. 6, for an explicit view. Data points measured from grids cut through by a crack are labeled –at fracture+, while those adjacent grids free from cracking are labeled safe+. Due to the limitation of the grid technique, it should be noted that the strain value at a given point actually represents an average of strains within the grid size (1.27 mm). In many cases, the limitation can cause an apparent discontinuity in strain values between grids located at crack and outside crack. In order to work out a forming limit curve or band as a form of FLD, some artificial but pro-safety data treating rules are followed. Here the lower bound of the scatter band for –at fracture+ data points is fitted analytically and defined as the –upper boundary+. Similarly, the upper bound of the scatter band for –safe+ data points is also fitted analytically and defined as the –lower boundary+. Then, the difference between the –upper boundary+ and the –lower boundary+ at zero minor strain is defined as the –intermediate range+. Now the upper and lower bounds of forming limit band are obtained by shifting the –upper boundary+(along major strain axis) down 50% of the –intermediate range+ and by shifting the –lower boundary+ up 25% of the –intermediate range+, respectively. The forming limit bands thus formed act as FLDs for the present study and are shown in FIG. 7 for different forming temperatures. A gross trend is seen in FIG. 7 that the forming limit strain increases with increasing forming temperature (250 degrees C.–350 degrees C.). The forming limit strains for the three aluminum alloys formed at 250 degrees C. are already comparable to those of A-K steels formed at room temperature under various forming conditions. At a forming temperature of 350 degrees C., the forming limit strain value of the two strain hardened aluminum alloys (Al 5754 and Al 5182+Mn, FIG. 7-*a, b*), in terms of major strain, is at least 2~3 times that of A-K steels formed at room temperature. This further confirms the great potential of these aluminum sheet alloys in automotive applications. As is shown in FIG. 7-*a,* the position of the forming limit band for alloy 5754 is very sensitive to forming temperature and it shifts steadily to a higher major strain region as temperature increases. For alloy 5182+Mn (FIG. 7-*b*), the forming limit band is elevated with increasing temperature up to 300 degrees C. Then, at temperatures at and higher than 300 degrees C., the position of the forming limit band becomes insensitive to temperature variation. By contrast, the forming limit bands for alloy 6111-T4 formed in the temperature range of 250 degrees C.–350 degrees C. are very close to each other, although the forming limit strain level also increases steadily with increasing temperature. Recall from FIG. 2 that the part depth of alloy 5182+Mn is less sensitive to forming temperature (especially at temperature (300 degrees C.) than that of alloy 5754 and that the part depth of alloy 6111-T4 varies more moderately with forming temperature as compared with the other two alloys. It is thus suggested that there exists a consistency in representing the formability by part depth and by FLD. For the present test conditions, evaluations by part depth and FLD give an identical ranking of formability among the three alloys. Considering that there is not a standard method to construct an FLD, the FLD data in the present study, expressed as forming limit band, may not be exactly comparable to those established mostly from stretching type operations for many engineering alloys. As is described earlier, the forming limit band is purely a best fit of experimental data points obtained around a cracked area. The aim of the present FLD approaches is to locate a gross trend on what level the limit strain can reach, as an approximate measurement of formability. On a typical FLD for an alloy formed at room temperature, there is an obvious trough position that generally corresponds to a plane strain condition (around zero minor strain). As can be seen from FIG. 7, either there is not a trough position on the forming limit band, or, the trough is not so obvious and is shifted to biaxial tensile strain regime. It may be partly due to the insufficient dada points around zero minor strain, and partly due to the very large cold rolling reduction ratio (all exceeding 70%) since prestrain may induce a change in the FLD location. Despite the uncertainties, the consistency between the FLD and the part depth evaluations in the present study reveals that the FLDs established here can serve as an appropriate, though approximate, measurement of the formability.

A good formability ensures a successful forming operation without crack initiation or even without heavy strain concentration in any site of the formed part, but it does not necessarily ensure a satisfactory performance in the application of the part. Consequently post-forming properties are also important aspects of the quality of a formed part. Form a mechanical viewpoint, a good product should not significantly lose its strength and ductility after forming, otherwise additional treatments have to be done to maintain the required properties. In the present investigation, tensile tests have been conducted using sheet specimens cut from the cup bottom area of formed parts. FIG. 8 shows post-forming tensile properties as related to forming temperatures (die-punch temperature combinations), with blank holding pressure (BHP) set at 1.1 MPa. At a definite die temperature, post-forming yield strength decreases with increasing punch temperature. Similarly, at a definite punch temperature, the yield strength also decreases with increasing die temperature. This implies a general softening effect with increasing forming temperature. The yield strength varies with forming temperature in a relatively steady manner for alloy 5754 (FIG. 8-*a*). For alloy 5182+Mn (FIG. 8-*c*), the yield strength seems more sensitive to punch temperature than to die temperature. In fact, as punch temperature reaches 300 degrees C. and over, the yield strength of alloy 5182+Mn does not change much over various die temperatures. A similar softening effect is also evidenced in alloy 6111-T4. The range of the yield strength variation with forming temperature (200~350 degrees C.) is 105~255 MPa for alloy 5754, 150~350 MPa for alloy 5182+Mn and 145~175 MPa for alloy 6111-T4, respectively. A similar softening effect (due to warm forming) is also reflected in post-forming tensile elongation data shown in FIGS. 8(*b, d*) for alloys 5754 and 5182+Mn, with relation to forming temperature. The elongation—forming temperature relation exhibits a trend opposite to that of the yield strength, i.e. the elongation increases with increasing both die temperature and punch temperature (FIGS. 8-*b, d*). The variation of elongation for alloy 6111-T4 exhibits an identical trend. The range of the elongation variation for the whole warm forming regime is 8–27% for alloy 5754, 9–26% for alloy 5182+Mn, and 19–27% for alloy 6111-T4, respectively. In Table 2, tensile properties at various tempers are compared for the three alloys, with their as-received tempers in the hot-rolled tempers. It should be noted that the temper prior to warm forming was the cold-rolled condition for alloys 5754 and 5182+Mn but it was the T4 condition for alloy 6111. As is indicated by data in Table 2, upon forming at a relatively low temperature of 200 degrees C., the yield strength is almost unchanged for alloys 5754 and 5182+Mn but is increased for alloy 6111-T4. The thermally activated softening occurring during the 200 degrees C. forming of the cold-rolled 5xxx alloys may counterbalance the hardening due to the build-up of forming-strain within the formed part, leading to a negligible variation in the post-forming yield strength. For alloy 6111-T4, a forming temperature of ~200 degrees C. may not induce a significant softening effect, and the forming-strain hardening may dominate and cause the strength elevation upon forming. For the 5xxx alloys, the elongation post-200 degrees C. forming increases very slightly over the value prior to forming. For alloy 6111-T4, corresponding to the strength elevation, the elongation post-200 degrees C. forming decreases moderately. After forming at a high temperature of 350 degrees C., there is a substantial drop in the yield strength for the 5xxx alloys but a quite moderate drop for alloy 6111-T4. As temperature increases, thermally activated softening effect should play a more important role than the forming-strain hardening, though the softening may have a less influence on alloy 6111-T4 than on the other two alloys. Upon 350 degrees C. forming, the elongation is elevated evidently over the one prior to forming, with the elevation much higher in the 5xxx alloys than in alloy 6111-T4. It is important to note from Table 2 that the yield strength and elongation values obtained upon forming even at a temperature as high as 350 degrees C. are quite close to or better than those measured in the as-received (hot-rolled) tempers.

In FIG. 9, the post-forming mechanical properties are shown for their dependence on BHP experienced during forming. While a similar trend is observed for various die-punch temperature settings, FIG. 9 gives an example showing the BHP effect under two die-punch temperature settings: 250 degrees C.–200 degrees C. and 350 degrees C.–300 degrees C. It is found that, for both 5754 and 5182+Mn alloys, the post-forming yield strength increases with increasing BHP (FIGS. 9-*a, c*). In accordance, the post-forming elongation decreases with increasing BHP (FIGS. 9-*b, d*). As is indicated earlier, increasing BHP increases the proportion of stretching relative to drawing. In other words, the strain level on the cup bottom area (from where tensile specimens have been taken) increases with increasing BHP. Consequently, the work-hardening effect contributes to the increased post-forming yield strength (decreased elongation) with increasing BHP. However, with a ~6 MPa increase of BHP, both the yield strength and the elongation do not change very much, no more than about 10%. Automotive body parts usually undergo some paint-baking process. As a simulation to some typical industrial cases, an alternative set of samples cut from the formed parts have baked at 177 degrees C. for 30 minutes before tensile testing. In FIG. 10, the post-forming tensile properties have been compared between as-formed and baked tempers. In FIG. 10, the baking effect is shown for the yield strength (FIG. 10-*a*) and the elongation (FIG. 10-*b*) obtained for the parts formed at different punch temperatures with die temperature set at 350 degrees C. and BHP set at 1.1 MPa, as an example. It is found that the baked specimens follow an identical trend to that of the as-formed specimens. For the baked specimens, the yield strength is consistently lower and the elongation is consistently higher than the as-formed specimens, but the differences are quite slight. Also in FIG. 10, the post-forming tensile properties are compared between the as-formed and the baked specimens under different BHPs, with a die-punch temperature setting of 250 degrees C.–200 degrees C. (FIGS. 10-*c, d*). With increasing BHP, the tensile properties of the baked specimens exhibit identical trends to those of the as-formed specimens (see FIG. 9). Again, for the baked specimens, the yield strength is slightly lower and the elongation is slightly higher than the as-formed specimens. Post-forming tensile test results on the other two alloys and on specimens formed at other die-punch temperatures indicate a similar trend regarding the baking effect and, the difference between the as-formed and baked specimens is less than 10 MPa for the yield strength and less than 1% for the elongation. As such, a conventional paint-baking process should not bring sizable change of mechanical properties to the warm formed aluminum parts 4. The three aluminum sheet alloys, Al 5754, Al 5182+Mn and Al 611 1-T4, exhibit a significant improvement in their formability in the biaxial warm forming at temperatures ranging from 200 degrees C. to 350 degrees C. A more satisfactory formability is found in the two strain hardened alloys (5754 and 5182+Mn) than in the precipitation hardened alloy (6111-T4). A consistent evaluation of formability is given by forming limit diagram FLD) as well as by part depth. The formability of the aluminum sheet alloys formed at 250 degrees C., in terms of FLDs, are already comparable to those of A-K steels formed at room temperature. While increasing forming temperature and/or blank holding pressure (BHP) increases the proportion of stretching, the formability of the present biaxial forming is drawability-dominated and hence, setting die to be hotter than punch promotes achieving a greater part depth than otherwise. For the present alloys and forming conditions, an optimum part depth is obtained by setting die temperature about 50 degrees C. higher than punch temperature. Also, a low BHP (~1 MPa) is more favorable in improving the drawability. Warm forming in the temperature range of 200 degrees C.–350 degrees C. may not cause a drastic loss in the strength level of the formed part. For the present cases, even the part formed at 350 degrees C. can maintain a strength level comparable to that of as received (hot-rolled) tempers. Heating the formed part at 177 degrees C. for 30 minutes does not make a sizable change to the tensile properties. Therefore paint-baking under a similar condition will not deteriorate the formed part.

To form complex parts from aluminum alloys, use of elevated temperatures is often necessary. Elevated temperature forming improves the formability of these alloys, but often reduces the strength of the formed part in comparison to that achieved by room temperature forming. For example, in non-heat treatable aluminum alloys (e.g. 5000 series alloys) dynamic recovery effects cause strength loss when parts are formed at elevated temperature. For heat-treatable alloys (e.g. 6000, 7000 series), it is possible to recover such strength drop by solution treatment and age hardening the alloy, but this is impractical in a formed part because of distortions encountered during solution treatment and quenching of the alloy. For applications requiring high strength in the formed part, it is necessary to avoid such strength loss, and if possible enhance strength over that of the fully annealed initial workpiece.

A method has been found to produce a high degree of yield strength in a 5000 series alloy, such that as the alloy undergoes elevated temperature forming at a fast forming rate, the drop in strength is insufficient to bring the alloy back to its fully annealed state. The resulting yield strength of the alloy can be considerably higher than that of conventional aluminum alloys for such applications, and can even be higher than that of steel parts. The necessary solution has several requirements:

(i) A chemical addition to the alloy to slow the kinetics of strength loss during elevated temperature recovery process. Additions of Mn, Ni and/or Ti in a moderately rich aluminum alloy can change both the character of solid solution and intermetallic dispersoid particles formed, and thereby slow the kinetics of dislocation recovery or strength loss.

(ii) The alloy should be cold rolled (or otherwise cold deformed) to a high level of plastic strain, such as 85%–90% rolling reduction or more, to impart a very high dislocation density in the workpiece.

(iii) Forming must be performed at elevated temperatures to assure that the alloy has sufficient formability in spite of the above alloy additions and the high cold reduction, both of which tend to detract from its formability at ambient temperature.

(iv) Forming must be performed by using preheated dies and punch, and a high forming rate, rather than heating the workpiece first which tends to soften it. The short residence time for heated die forming is critical in minimizing thermal exposure and strength loss during forming, but the exposure should be long enough to allow some degree of dynamic recovery required to enhance formability.

An Al—4.5%Mg alloy in which 0.25% Zn and 0.15% Cu was added (regarded as a non-heat treatable alloy) was enriched with 1.05% Mn, and was DC-cast, homogenized and hot rolled to 0.3". The alloy was cold rolled to 0.035". The cold rolled alloy has yield strength approaching 400 MPa. During hot die forming of the alloy (between strain rates of 1–1.5 s–1 strain rate), it experienced a temperature in the range of 250–3500 C. for 1–2 second. After successful forming of the part due to excellent formability at this temperature, the formed part had yield strength in the range of 230–280 MPa. This strength level is significantly higher than what is generally observed in non-heat treatable alloy (170 MPa), and even higher than that for heat treatable alloy (155–220 MPa, before and after the heat treatment respectively). In fact, the observed strength of the formed alloy is greater than that of steel (210 MPa).

Biaxial warm forming behavior in the temperature range of 200 degrees C.–350 degrees C. was demonstrated for three automotive aluminum sheet alloys: Al 5754, Al 5182 containing 1%Mn (5182+Mn) and Al 6111-T4. While the formability for all the three alloys improved at elevated temperatures, the strain hardened alloys 5754 and 5182+Mn showed considerably greater improvement than the precipitation hardened alloy 6111-T4. Even without the precipitation treatment the formability of alloy 6111 could not be improved. Rectangular parts can be formed at a rapid rate using internally heated punch and die in both isothermal and non-isothermal conditions. Temperature effect on drawing of the sheet has a large effect on formability. Setting die temperature slightly higher than punch temperature favorably promoted formability. Forming limit diagram (FLD) under warm forming conditions showed results consistent with the evaluation of part depth. Post-forming tensile test results confirmed that rapid warm forming in the above-mentioned temperature range does not create a significant loss in yield strength. After a simulated paint-baking treatment (177 degrees C. for 30 min.) the sheet retained strength level in the part similar to current stamped parts.

For a more complete understanding of the present invention, reference is made to the following detailed description when read with in conjunction with the accompanying drawings wherein like reference characters refer to like elements throughout the several views, in which:

BRIEF DESCRIPTION OF THE DRAWINGS

FIG. 7A illustrates effects of forming temperature on FLD for alloy 5754:

FIG. 7B illustrates effects of forming temperature on FLD for alloy 5182+Mn:

FIG. 7C illustrates effects of forming temperature on FLD for alloy 6111-T4:

FIG. 8A illustrates post-forming room temperature properties for yield strengths for alloy 5754;

FIG. 8B illustrates post-forming room temperature properties for elongation for alloy 5182+Mn, FIG. 8C illustrates post-forming room temperature properties for yield strengths for alloy 5192+Mn, FIG. 8D illustrates post-forming room temperature properties for elongation for alloy 5182+Mn;

FIG. 9A illustrates effects of blank holding pressure on postforming room temperature properties, etc. for alloy 5754;

FIG. 9B illustrates effects of blank holding pressure on post-forming room temperature properties, etc. for alloy 5754;

FIG. 9C illustrates effects of blank holding pressure on post-forming room temperature properties, etc. for alloy 5182+Mn;

FIG. 9D illustrates effects of blank holding pressure on post-forming room temperature properties, etc. for alloy 5182+Mn;

FIG, 10A illustrates a comparison between room temperature tensile properties (yield strength) and baked conditions for alloy 5182+Mn for die temperature of 350 degrees C.;

FIG. 10B illustrates a comparison between room temperature tensile properties (elongation) and baked conditions for alloy 5182+M for a die-punch temperature setting of 350 degrees C.;

FIG. 10C illustrates a comparison between room temperature (yield strength) tensile properties and baked conditions for alloy 5182+Mn for a die-punch temperature setting of 250 degrees C.–200 degrees C., FIG. 10D illustrates a comparison between room temperature tensile properties (elongation) and baked conditions for alloy 5182+Mn for a die-punch temperature setting of 250 degrees C.–200 degrees C.

Table 1 illustrates chemical compositions (wt. %) of sheet alloys;

Table 2 illustrates room temperature tensile properties obtained for different tempers;

DESCRIPTION OF THE PREFERRED EMBODIMENTS

Figure 1A:
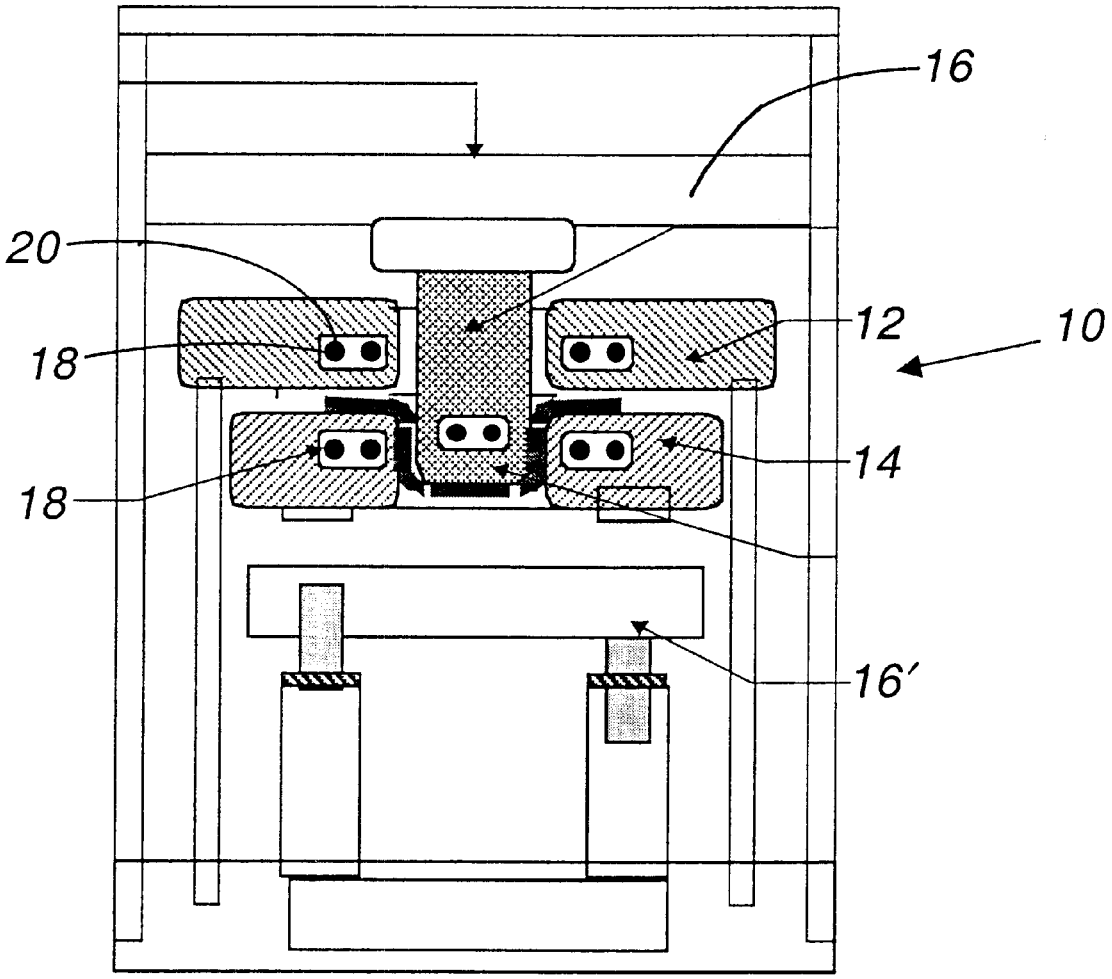
FIG. 1A illustrates a sectional view of warm forming dies according to the invention having heating blocks on flat male protrusions and on the binder surface.
Figure 1B:
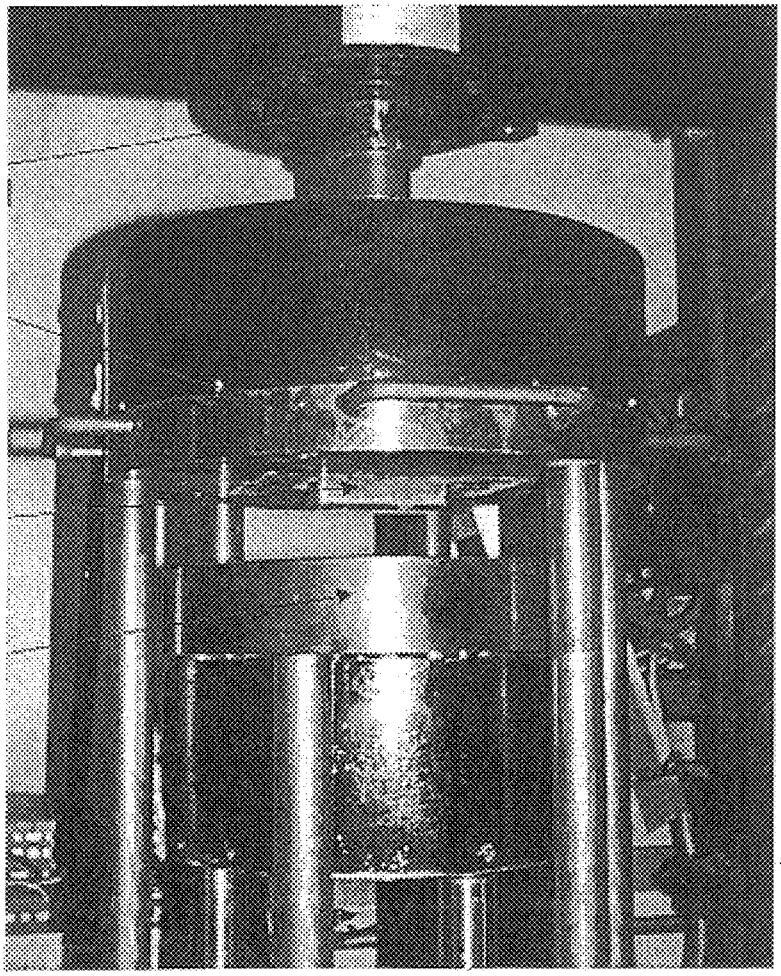
FIG. 1B illustrates a photographic view of the warm forming dies of FIG. 1A.
Figure 1C:
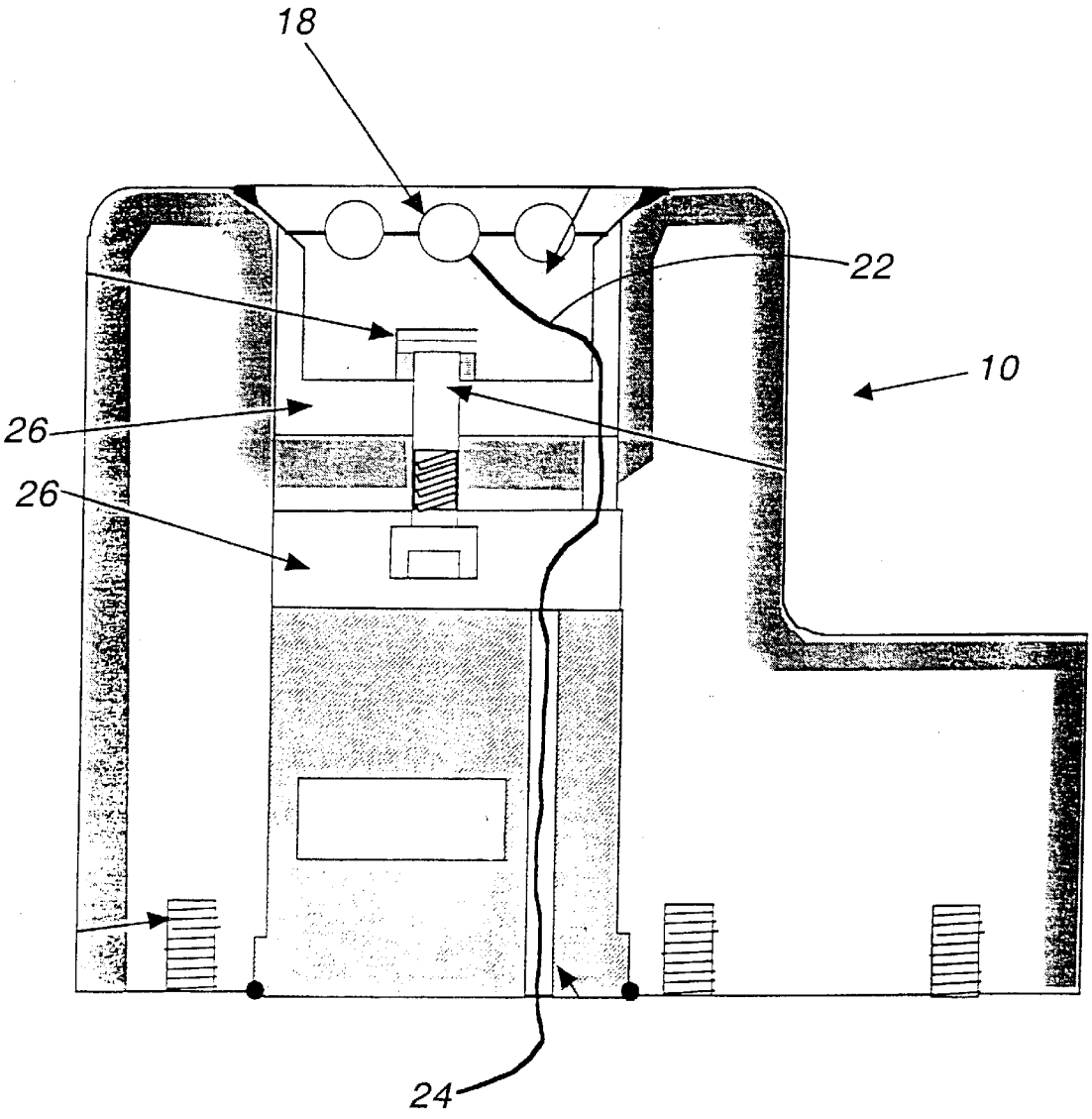
FIG. 1C illustrates a sectional view through a forming die according to the invention having local surface heating by electric heaters.
Figure 1D:
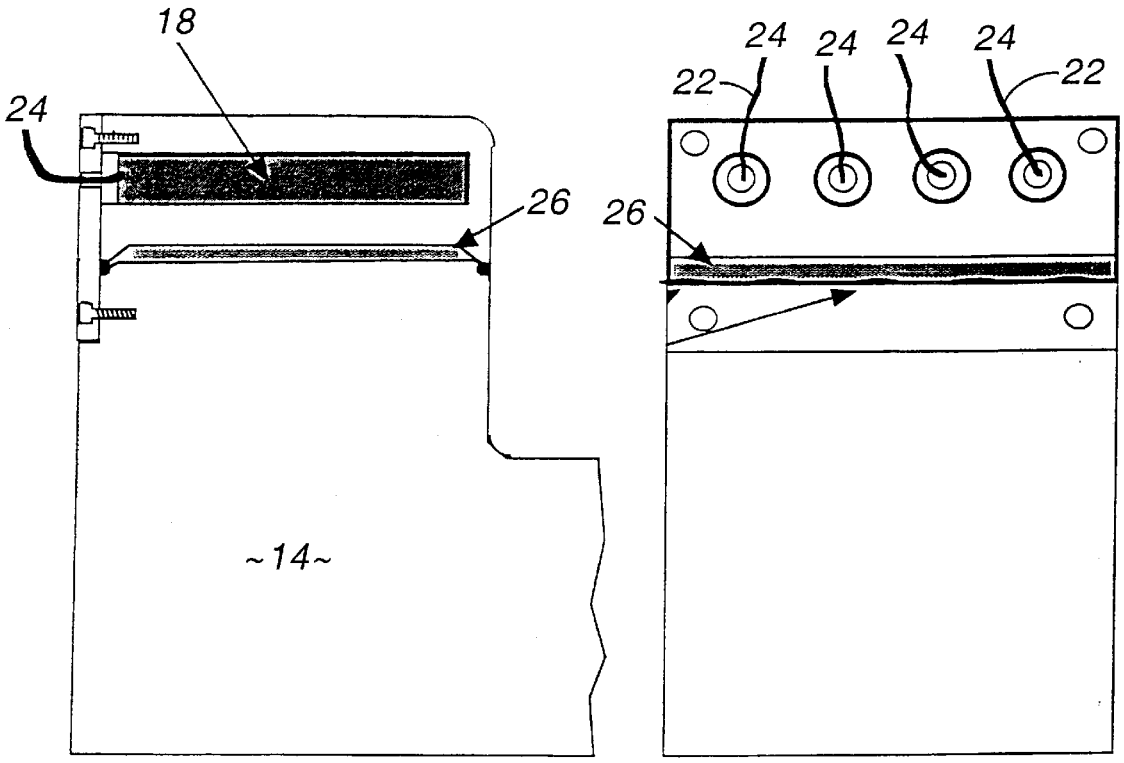
FIG. 1D illustrates a sectional front view and side view of a portion of a die having heater inserts according to the invention.

A warm forming die 10 having an upper die 12 and a lower die 14 is shown in schematic in FIG. 1A and in a photograph in FIG. 1B. Bolsters 16, 16' support the upper die 12 and the lower die 14, respectively. Both the upper die 12 and the lower die 14 have heating blocks 18 inserted thereinto. The heating blocks 18 are welded into spaces in the dies 12 and 14. Each heating block 18 contains apertures 20 for the placement of cartridge heating elements 20 therein. The heating elements 20 are connected by wires 22 to a power supply 24. The warm form die is better shown in close up sectional view in FIG. 1C. Insulation 26 placed between the die and the heating block limits the transfer of heat to the die (FIG. 1D).

Figure 1E:
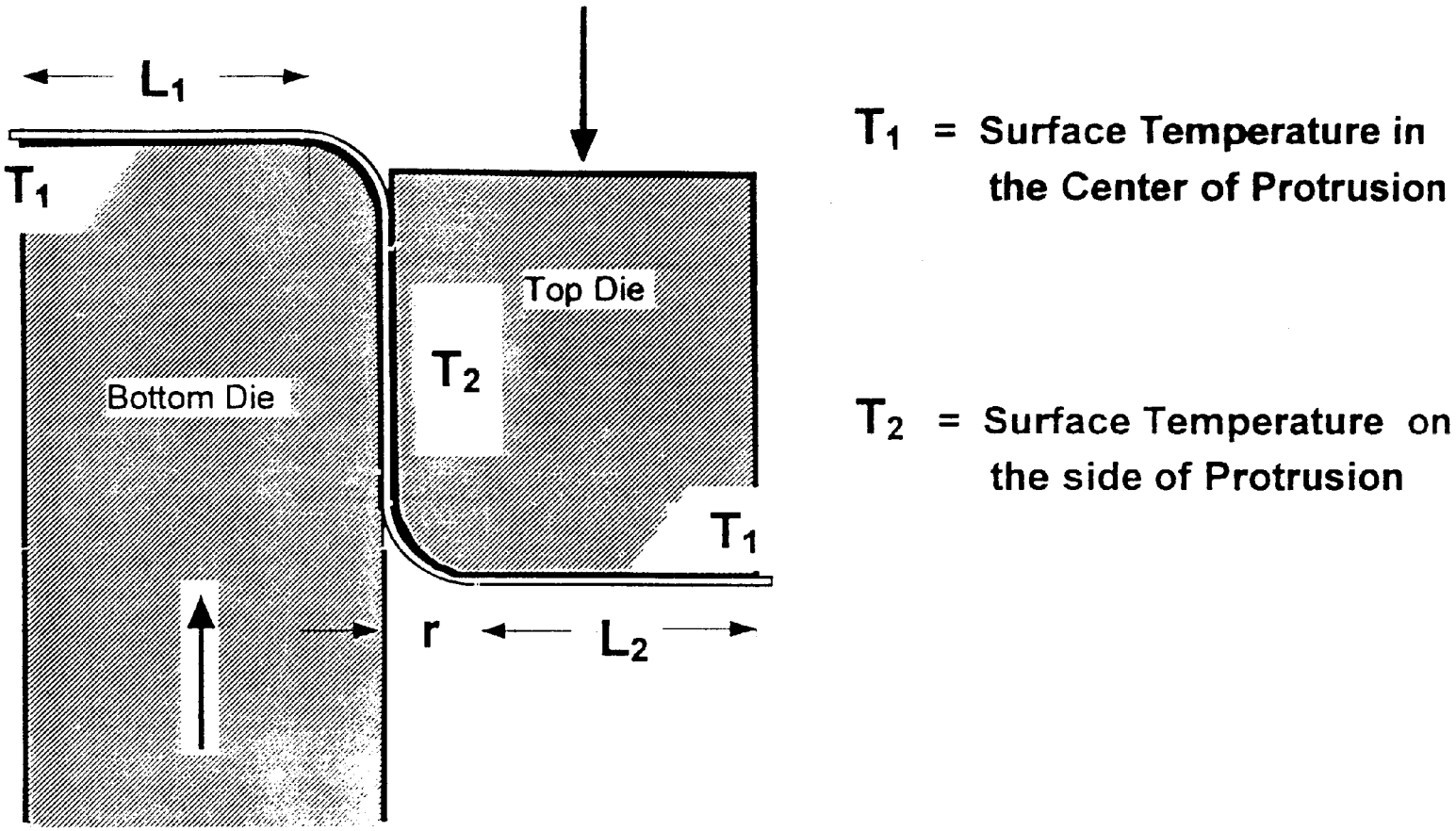
FIG. 1E illustrates relative motion between protrusions on upper and lower dies.
Figure 1F:
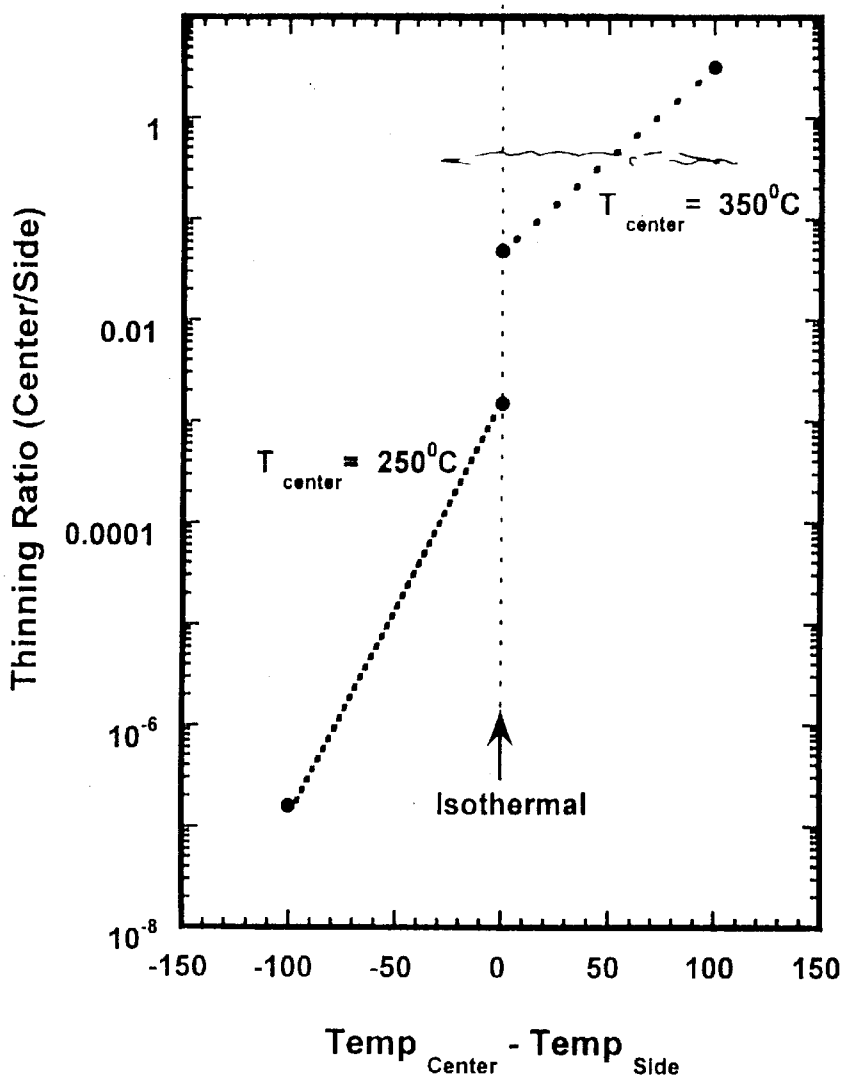
FIG. 1F illustrates effect of temp excursions on thinning rates.
Figure 1G:
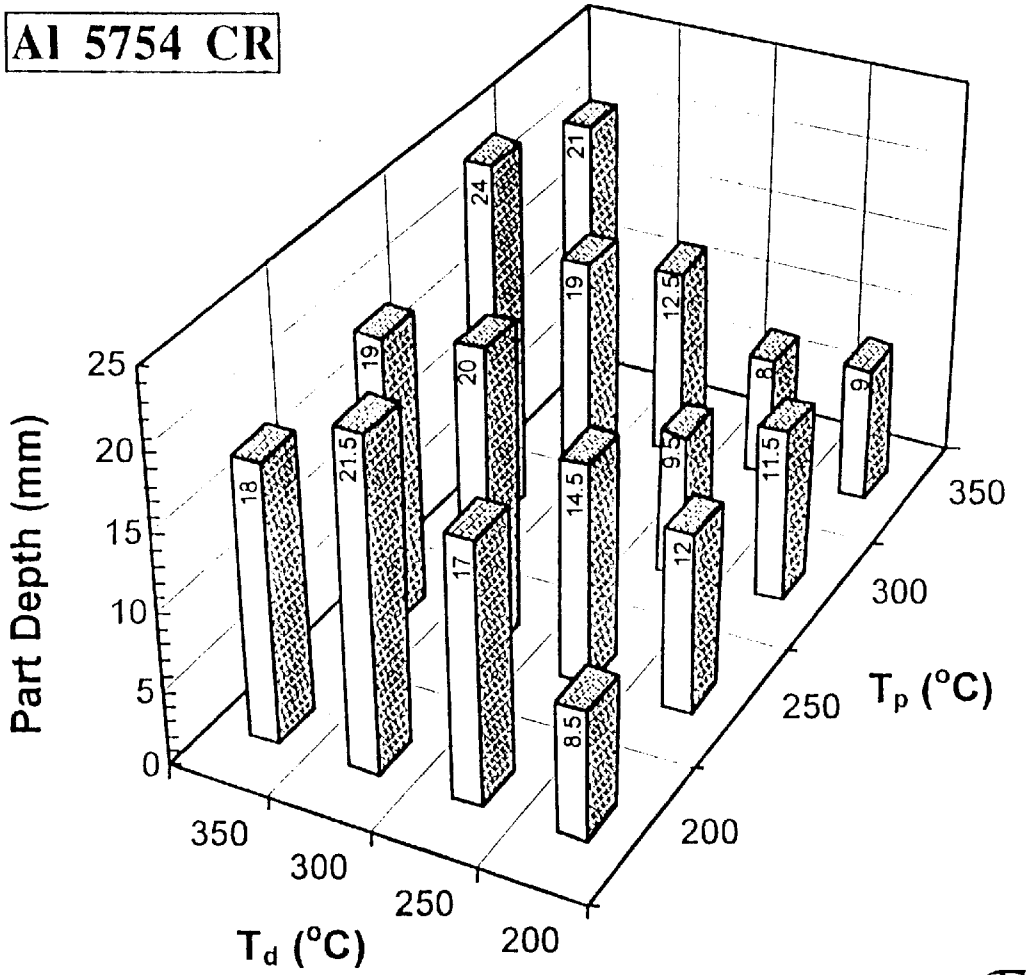
FIG. 1G illustrates biaxal warm forming part depth versus punch temperature and die temperature.
Figure 1H:
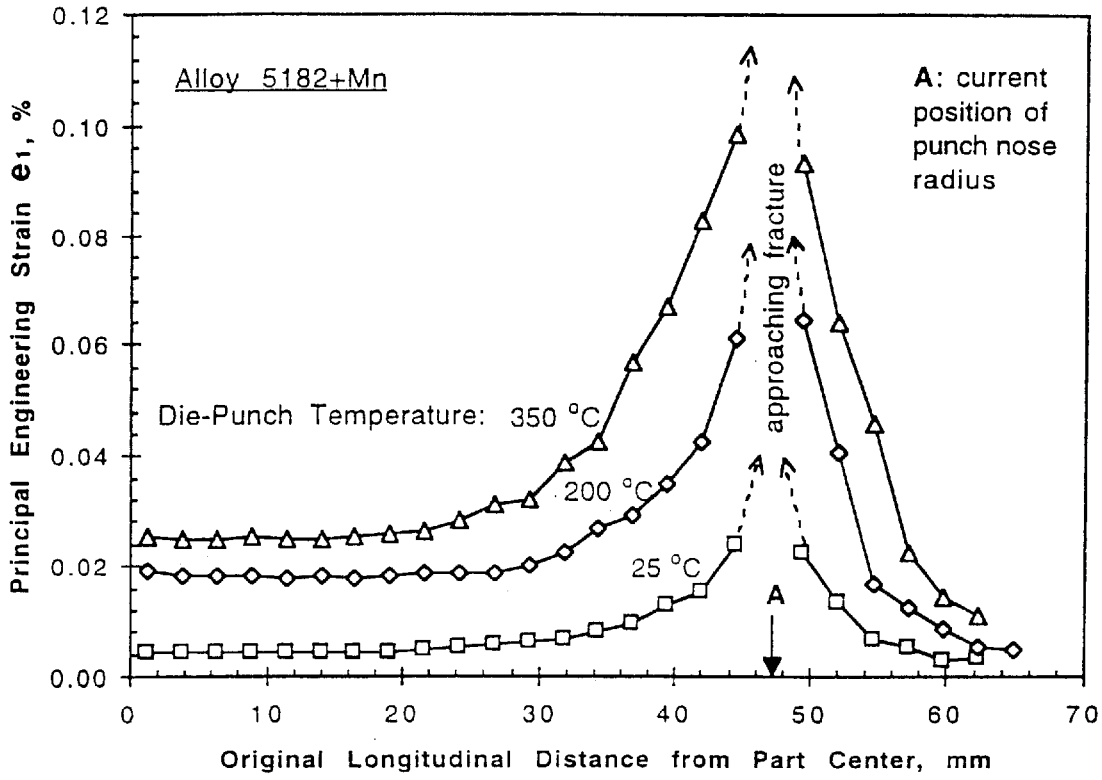
FIG. 1H illustrates effect of forming temperature on the distribution of principal engineering strain along major dimensions.

Relative motion between protrusions on upper and lower dies is depicted in FIG. 1E with the effect of temp excursions on thinning rates depicted in FIG. 1F. Biaxial warm forming part depth versus punch temperature and die temperature is shown in FIG. 1G while FIG. 1H shows the effect of forming temperature on the distribution of principal engineering strain along major dimensions.

Figure 2A:
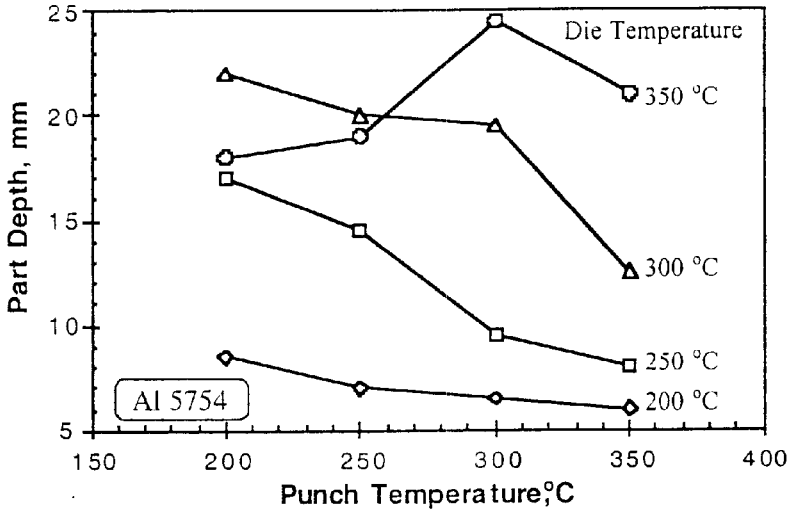
FIG. 2A illustrates part depth plotted against punch temperature at different die temperatures for alloy 5754 in cold-rolled condition.
Figure 2B:
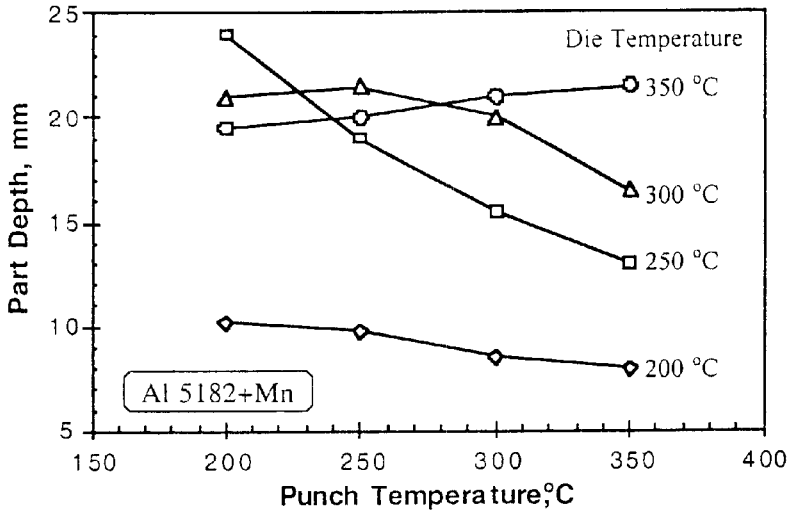
FIG. 2B illustrates part depth plotted against punch temperature at different die temperatures for alloy 5182+Mn in cold-rolled condition.
Figure 2C:
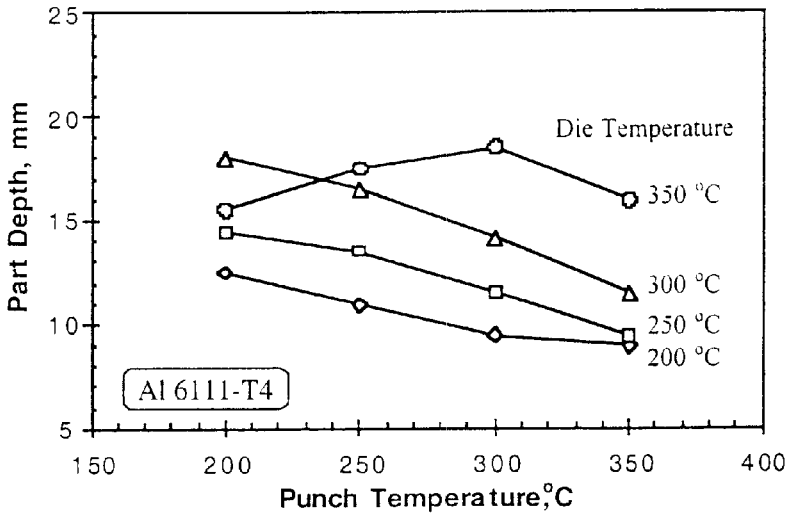
FIG. 2C illustrates part depth plotted against punch temperature for alloy 6111 in the T4 condition prior to warm forming.

Part depth is plotted against punch temperature at different die temperatures for alloys 5754 and 5182+Mn in cold-rolled condition (FIGS. 2A and 2B) and for alloy 6111 in the T4 condition prior to warm forming (FIG. 2C).

Figure 3:
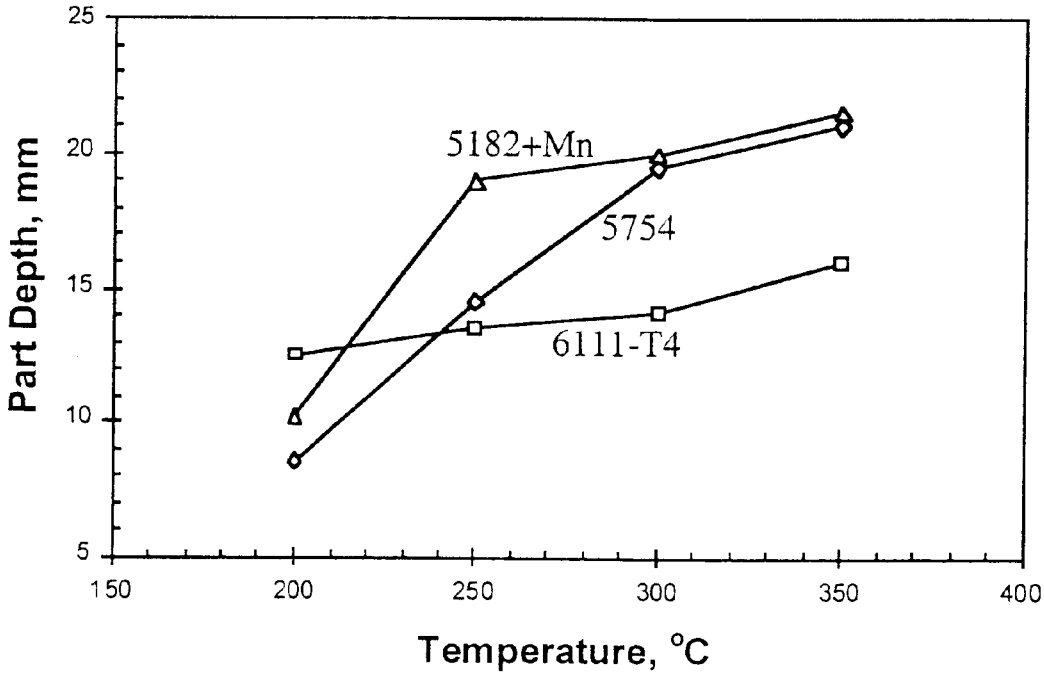
FIG. 3 illustrates variation of part depth with forming temperatures under conditions of isothermal heating for the three alloys.

Variations of part depth with forming temperatures under conditions of isothermal heating for the three alloys are depicted in FIG. 3.

Figure 4A:
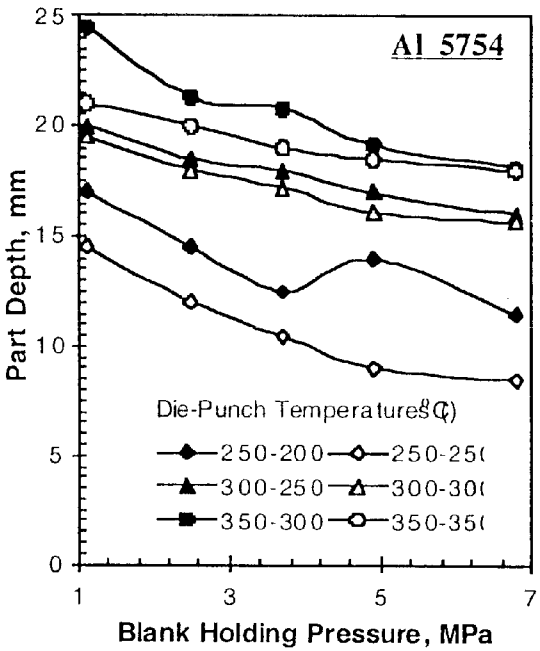
FIG. 4A illustrates how part depth varies with blank holding pressure at various die-punch temperature combinations for alloy 5754.
Figure 4B:
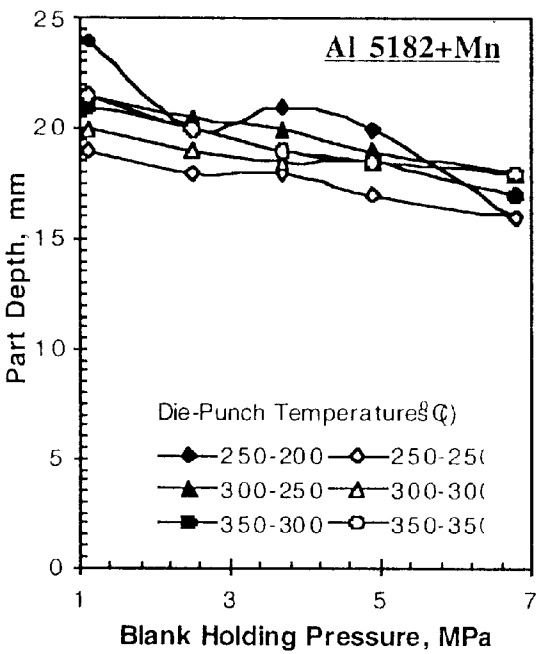
FIG. 4B illustrates how part depth varies with blank holding pressure at various die-punch temperature combinations for alloy 5182+Mn.
Figure 4C:
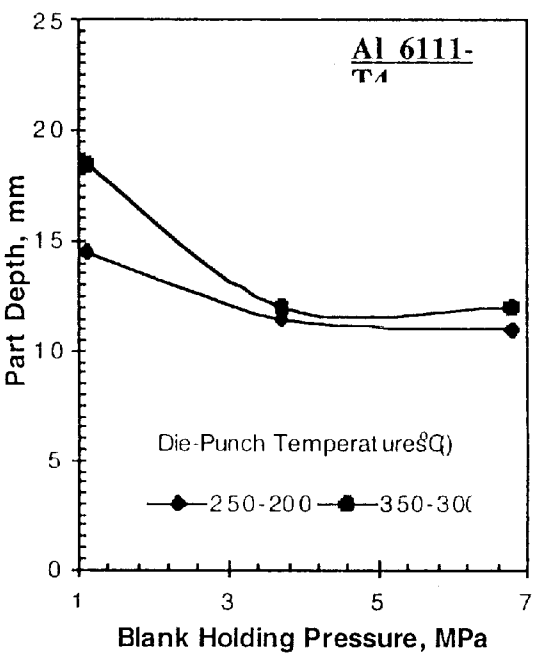
FIG. 4C illustrates how part depth varies with blank holding pressure at various die-punch temperature combinations for alloy 6111-T4.

Comparing the part depth-BHP curves for different die-punch temperature settings with blank holding pressure at various die-punch temperature combinations for alloys 5754, 5182+Mn, and 6111-T4 are shown in FIGS. 4A–4C.

Figure 5:
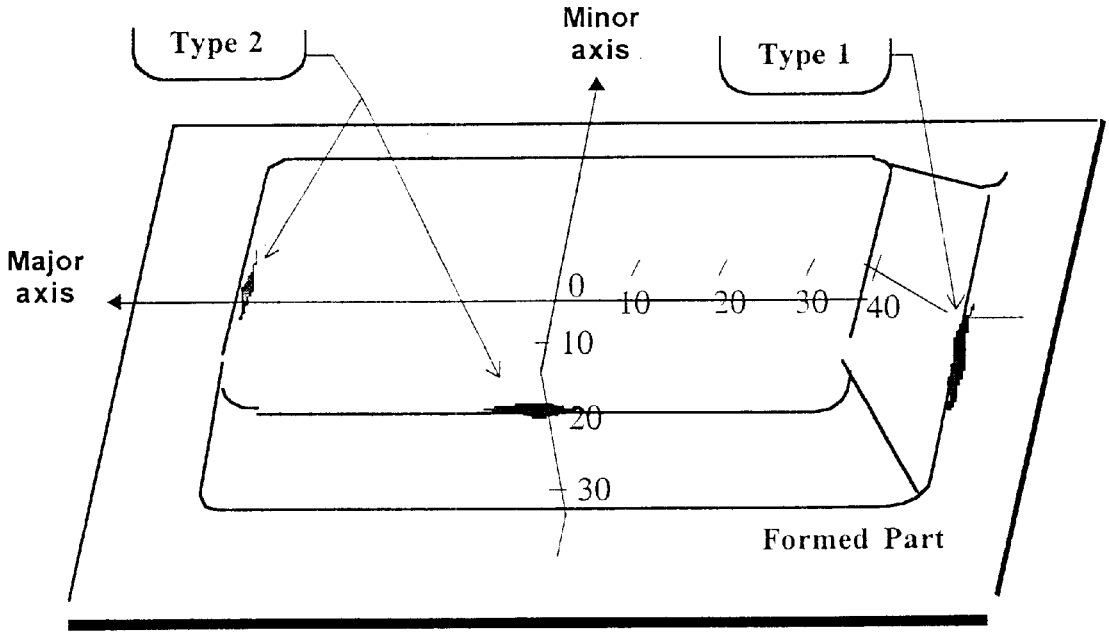
FIG. 5 illustrates schematically locations for FLD measurements, corresponding to two types of crack initiation modes (Type 1 and Type 2) linked to two different die-punch temperature assignments.
Figure 6:
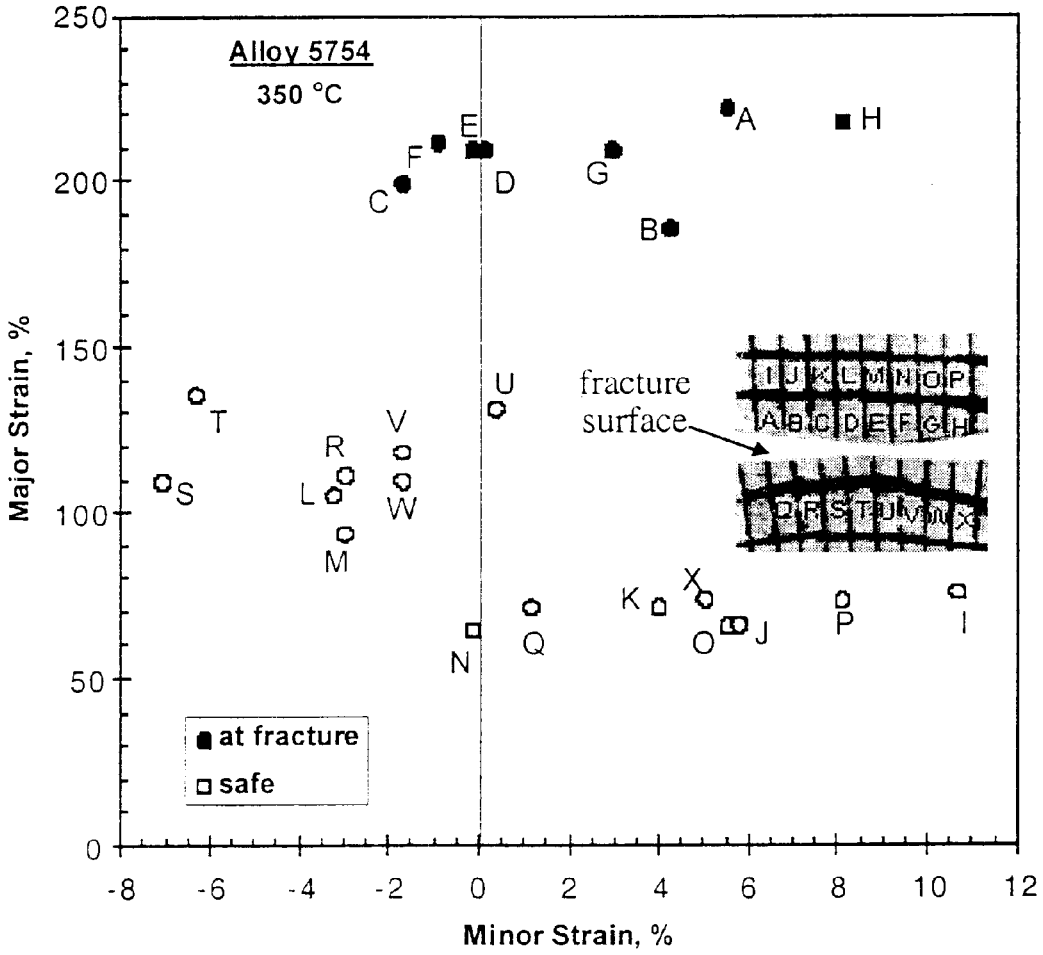
FIG. 6 illustrates minor and major strains around a crack showing how an FLD was constructed.

Locations for FLD measurements, corresponding to two types of crack initiation modes (Type 1 and Type 2) linked to two different die-punch temperature assignments are depicted in FIG. 5. A crack generally initiates at the edge of the rectangular cup (Location Type 1) contacting the transverse dimensional die. When die temperature is set lower than punch temperature, hotter punch allows for relatively more stretching and hence, strain concentration and crack initiation generally occur at the cup bottom edge (Location Type 2) contacting the punch nose radius and/or on the bottom corner. When die and punch are set at the same temperature (an isothermal heating condition), a crack may initiate at Type 1 and/or Type 2 locations, but the more likelihood in Type 2. Minor and major strains around a crack showing how an FLD was constructed are depicted in FIG. 6.

A trough position can be formed on the forming limit band, or, the trough is not so obvious and is shifted to biaxal tensile strain regime. Effects of forming temperature on FLD for alloys 5754, 5182+Mn and 6111-T4 are shown in FIGS. 7A–7C, respectively.

FIGS. 8A–8B illustrate post-forming room temperature properties for yield strengths and elongation for alloy 5754. FIGS. 8C–8D illustrate post-forming room temperature properties for yield strength and elongation for alloy 5182+Mn.

Post-forming mechanical properties are shown for their dependence on BHP experienced during forming, for yield strength and elongation are shown for alloy 5754 in FIGS. 9A–9B. Similarly, the effects of blank holding pressure on post-forming room temperature properties, for yield strength and elongation are shown for alloy 5182+Mn in FIGS. 9C–9D.

A comparison between room temperature tensile properties (yield strength) and baked conditions for alloy 5182+Mn for die temperature of 350 degrees C. is depicted in FIGS. 10A–10B. Similarly, a comparison between room temperature (yield strength) tensile properties and baked conditions for alloy 5182+Mn for a die-punch temperature setting of 250 degrees C.–200 degrees C. is depicted in FIGS. 10B–10C.

Having described the invention, many modifications thereto will become apparent to those skilled in the art to which it pertains without deviation from the spirit of the invention as defined in the appended claims.

What is claimed is:

1. An apparatus for selectively warming a die having a flat region and a bend region to increase the strain level of a material to reduce excessive thinning of the material and to enable material flow of the material in the apparatus into the bend region from the flat region, the apparatus comprising:

means for warming at least one flat region of the die;

means for controlling the temperature of the means for warming the at least one flat region of the die; and means for measuring a temperature of a punch for use with the die, wherein the means for controlling the temperature of the means for warming the at least one flat region being controllable to achieve a desired temperature at the at least one flat region in a specific relation to the measured temperature of the punch.

2. The apparatus according to claim 1 wherein the specific relation of the desired temperature to the at least one flat region in a specific relation to the measured temperature of the punch being approximately 50 degrees C. higher than the measured temperature of the punch.

3. The apparatus according to claim 1 wherein the material is loosely held in the apparatus.

4. The apparatus according to claim 1 wherein the die has protrusions and regions between protrusions with metal stretch of the material occurring over protrusions, metal stretch of the material feeds material to regions being between the protrusions; and heat is controlled to a material holder to pull out more metal from the regions between the protrusions.

5. The apparatus according to claim 1 wherein means for warming comprises:

a heating block near the flat region of the die.

6. The apparatus according to claim 1 wherein means for warming further comprises:

the heating block having at least one aperture and an least one heating element positioned in the at least one aperture.

7. The apparatus according to claim 1 wherein means for warming further comprises:

a power supply for providing power; and a connector connecting the power supply with the at least one heating element.

8. The apparatus according to claim 1 further comprising means for insulating the means for warming from the die.

9. The apparatus according to claim 1 further comprising means for holding the means for heating to the die.

10. The apparatus according to claim 9 wherein the means for holding the means for heating to the die comprises a weld.

11. A method for employing the apparatus according to claim 1 for selectively warming a die having a flat region and a bend region to enable material flow into the bend region from the flat region, the method comprising the following step:

assembling means for heating near to a flat region of the die.

12. A method for employing the apparatus according to claim 1 for selectively warming a die having a flat region and a bend region to enable material flow into the bend region from the flat region, the method comprising the following steps:

assembling the die; and assembling means for heating near to a flat region of the die.

* * * * *